US007156919B2

(12) United States Patent
McLaughlin

(10) Patent No.: US 7,156,919 B2
(45) Date of Patent: Jan. 2, 2007

(54) PORTABLE METALLIZING SPRAY BOOTH

(75) Inventor: Daniel A. McLaughlin, N. Redington Beach, FL (US)

(73) Assignee: Spectra Chrome, LLC, Clearwater, FL (US)

( * ) Notice: Subject to any disclaimer, the term of this patent is extended or adjusted under 35 U.S.C. 154(b) by 14 days.

(21) Appl. No.: 11/017,999

(22) Filed: Dec. 21, 2004

(65) Prior Publication Data

US 2006/0130752 A1 Jun. 22, 2006

(51) Int. Cl.
*B05B 1/28* (2006.01)
*B05B 7/06* (2006.01)
*B08B 15/02* (2006.01)

(52) U.S. Cl. ..... 118/326; 118/313; 118/DIG. 7; 454/56

(58) Field of Classification Search ..... 118/326, 118/DIG. 7, 313; 55/DIG. 46; 454/50, 53, 454/56, 61–62
See application file for complete search history.

(56) References Cited

U.S. PATENT DOCUMENTS 2,090,827 A * 8/1937 Bak ..... 52/32
3,251,177 A * 5/1966 Baker ..... 55/385.1
3,861,989 A 1/1975 Ashenfarb et al.
4,114,853 A 9/1978 Medvick
4,532,886 A * 8/1985 Bouchard ..... 118/326
4,590,884 A * 5/1986 Kreeger et al. ..... 118/308
4,975,305 A 12/1990 Biginelli
5,152,462 A * 10/1992 Evans ..... 239/304
5,346,602 A 9/1994 McLaughlin
5,384,026 A 1/1995 McLaughlin
5,985,107 A 11/1999 McLaughlin
6,715,692 B1 * 4/2004 Peterson et al. ..... 239/8

* cited by examiner

*Primary Examiner*—Christopher A. Fiorilla
*Assistant Examiner*—Yewebdar Tadesse
(74) *Attorney, Agent, or Firm*—Larson & Larson; Frank Liebenow

(57) ABSTRACT

A bottom tray is supported by four wheels and is spaced apart from a bottom surface of a top frame member having two side walls and a back wall enclosing a grated work surface. A pair of pressurized tanks containing ingredients for metallizing an object are mounted under the side walls on the bottom tray. In addition, waste liquid tanks are positioned in a middle area of the bottom tray. Three spray guns are each attached by hoses to an air pressure source and a pressurized tank so that an operator can metallize an object by sequentially operating the spray guns.

20 Claims, 9 Drawing Sheets

PORTABLE METALLIZING SPRAY BOOTH

BACKGROUND OF THE INVENTION

The invention relates to an apparatus for spray painting articles of manufacture. More particularly, it refers to a compact spray table for imparting a chrome-like mirror finish on plastic, wood, aluminum, iron, stone and glass.

U.S. Pat. No. 3,861,989 describes applying to a glass sheet a coating of an alkyd resin, an epoxy resin, solvents and pigments. The coated glass sheet is then heated to remove solvent and cure the resin to produce a crackle finish decorative coating on the glass. Such a finish is not mirror-like and has to be treated with silvering solution to obtain reflective surface. In U.S. Pat. No. 4,975,305 an alkyd resin is used as a primer layer in a process for coating plastic, wood or metal articles in a spray booth. The search continues for improved processes for imparting high gloss finishes to manufactured goods and for a suitable spray booth that protects workers and prevents release of toxic vapors into the atmosphere.

SUMMARY OF THE INVENTION

The present invention is directed to an improved spray booth and improved process for coating chrome-like mirror finishes on manufactured items of varying types. The booth has a bottom tray supporting four pressurized 3–5 gallon tanks. These tanks contain the chemicals needed for a metallization process. Between the pressure tanks are waste recovery tanks. Above the tanks is an upper frame structure containing three upright walls enclosing a grated surface and a vertically narrow front wall. Three spray guns, with downwardly depending air pressure and chemical delivery hoses, are suspended from the front wall. A single air blower gun is also suspended from the front wall. The side walls contain perforated holes which allow the passage of vapors during the metallization process. Impeller blades contained in a housing attached to an outer surface of the side walls act to draw the vapors out of the spray booth.

BRIEF DESCRIPTION OF THE DRAWINGS

This invention can be best understood by those having ordinary skill in the art by reference to the following detailed description, when considered in conjunction with the accompanying drawings in which.

DETAILED DESCRIPTION OF THE INVENTION

Figure 1:
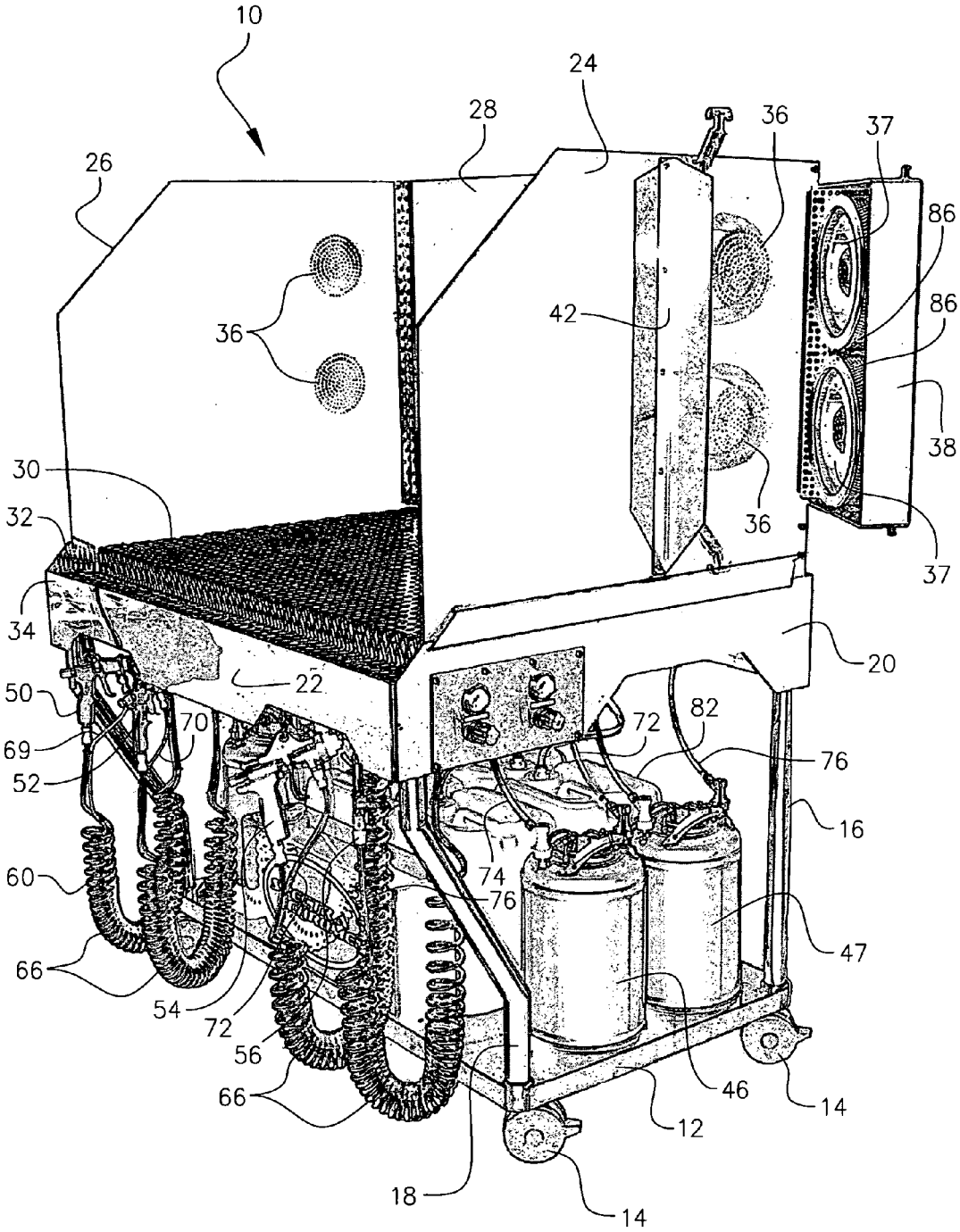
FIG. 1 is a perspective view of a spray booth of this invention.

Throughout the following detailed description, the same reference numerals refer to the same elements in all figures.

Referring first to FIG. 1, the spray booth 10 of this invention has a bottom tray 12 supported by four heavy duty identical moveable wheels 14 with locking brakes. A pair of rear vertical rods 16 and a pair of front offset vertically directed rods 18 support the upper frame structure 20 of the spray booth 10.

The upper frame structure 20 has a vertical front wall 22 of narrow vertical diameter, two oppositely positioned extended vertical side walls 24 and 26 and back wall 28 of similar height that enclose a grated work surface 30. The grated work surface 30 has a step down front surface 32 which is below a top portion 34 of front wall 22.

Figure 6:
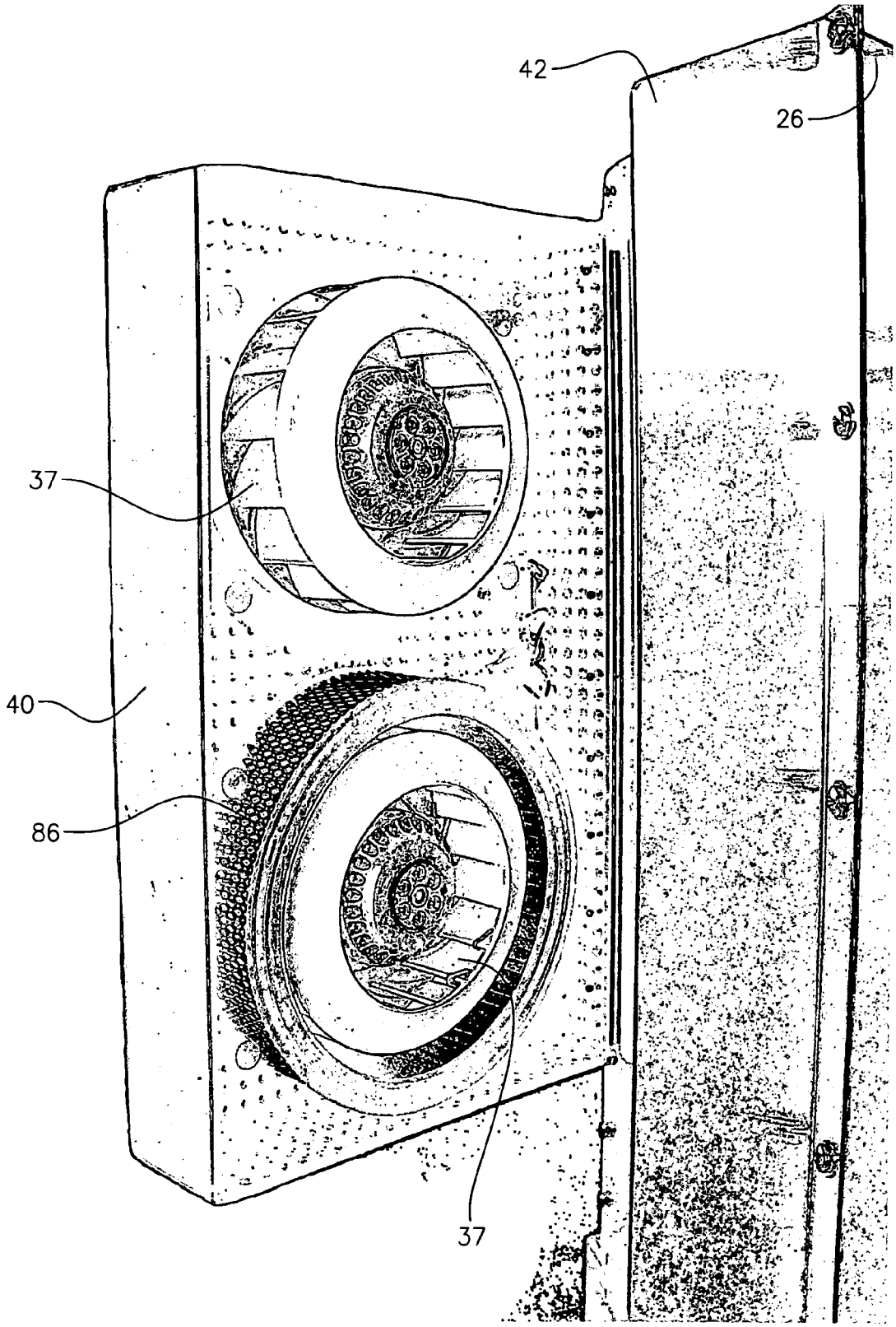
FIG. 6 is a blown up view of the impeller fans.

The side walls 24 and 26 contain circular perforations 36 for passage of vapors created on the grate work surface 30. A pair of impeller fans 37 are hingedly mounted within housing 38 attached to wall 24. Likewise a pair of impeller fans 37 are hingedly mounted within housing 40 attached to wall 26 (See FIG. 6). When an article is being coated the housings 38 and 40 are moved to a position covering the circular perforations 36 in walls 24 and 26 respectively. A stiffening member 42 is attached to wall 24 and 26. The impeller fans 37 evacuate over-spray mist created during a metallizing process. Mists or vapors are drawn away from the applicator's work space.

When needed, the entire spray booth 10 is manually moved in or out of any spray location with little effort.

The bottom tray 12 supports three gallon or five gallon stainless steel pressure tanks 46 and 47 on the right side and three gallon or five gallon stainless steel pressure tanks 48 and 49 on the left side.

Figure 2:
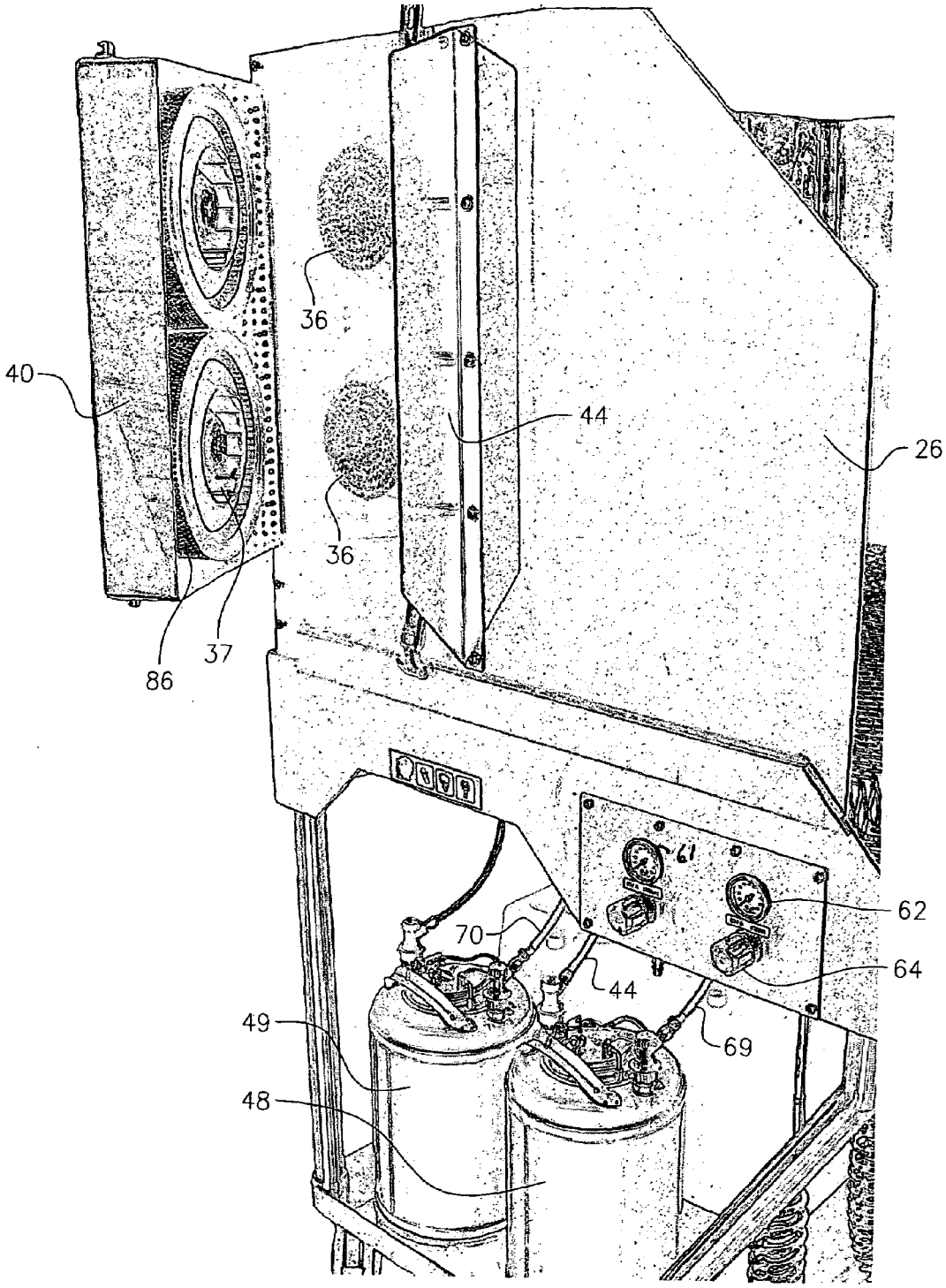
FIG. 2 is a left side elevational view of the spray booth.
Figure 3:
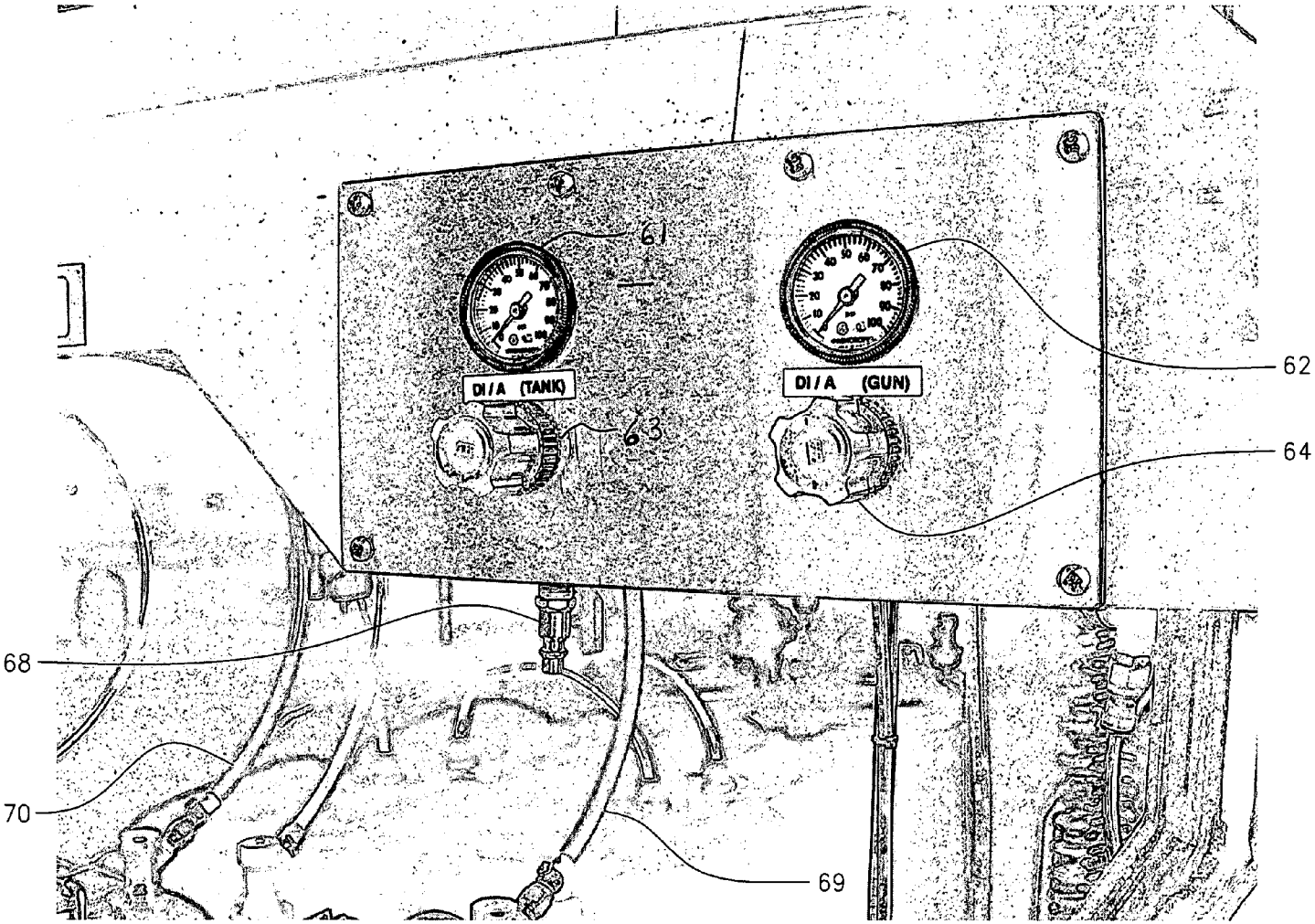
FIG. 3 is a blown up view of the pressure gauges employed on each side of the spray booth.

One high velocity dual headed spray gun 54 and two single headed spray guns 50, 52, together with one air blow gun 56 are mounted on hooks 58 attached to front wall 22. Spray gun 50 is connected by flex coil 60 to pressure tank 48 containing tin chloride. This provides a sensitizing coating on an article to be metallized. Air pressure from an external source through connector 68 is provided by an air compressor. Air pressure is provided to tank 48 by hose 44. Tank pressure is monitored by a gauge 61 and air pressure to guns 50 and 52 is monitored by gauge 62 mounted on the outer side of wall 26 (See FIGS. 2 and 3). Pressure regulation settings are made by turning knobs 63 and 64 below gauges 61 and 62, respectively. The coil 60 is colored green for easy identification. An outer coiled tube 66 contains air from the external air compressor connected to the system at connector 68 (See FIG. 3). Spray gun 52 is connected via tube 70 to tank 49 containing de-ionized water. The tube 70 is colored blue for identification. The de-ionized water is sprayed on the product being metallized after the tin chloride sensitizer coating has been applied. The outer coil 66 leads to the air pressure source. Dual headed spray gun 54 is attached to clear colored hose 72 attached to the right side of tank 46 containing silver nitrate solution mixed with ammonium hydroxide. Dual headed spray gun 54 is also attached to a red colored hose 76 attached to the right side of tank 47 containing a sorbitol reducer. The outer coil 66 is the hose leading to the air pressure source. Hose 74 leads into tank 46 and hose 82 leads into tank 47 from the air pressure source. Air blower gun 56 is attached to an external air source via outer coil 66. An outer hose 66 contains the source of air pressure. The contents of tanks 46 and 47 are sprayed simultaneously through dual headed gun 54. The mixture of these two products in front of the gun nozzle produces a silver mist which creates the chrome-like appearance on the part.

Figure 7:
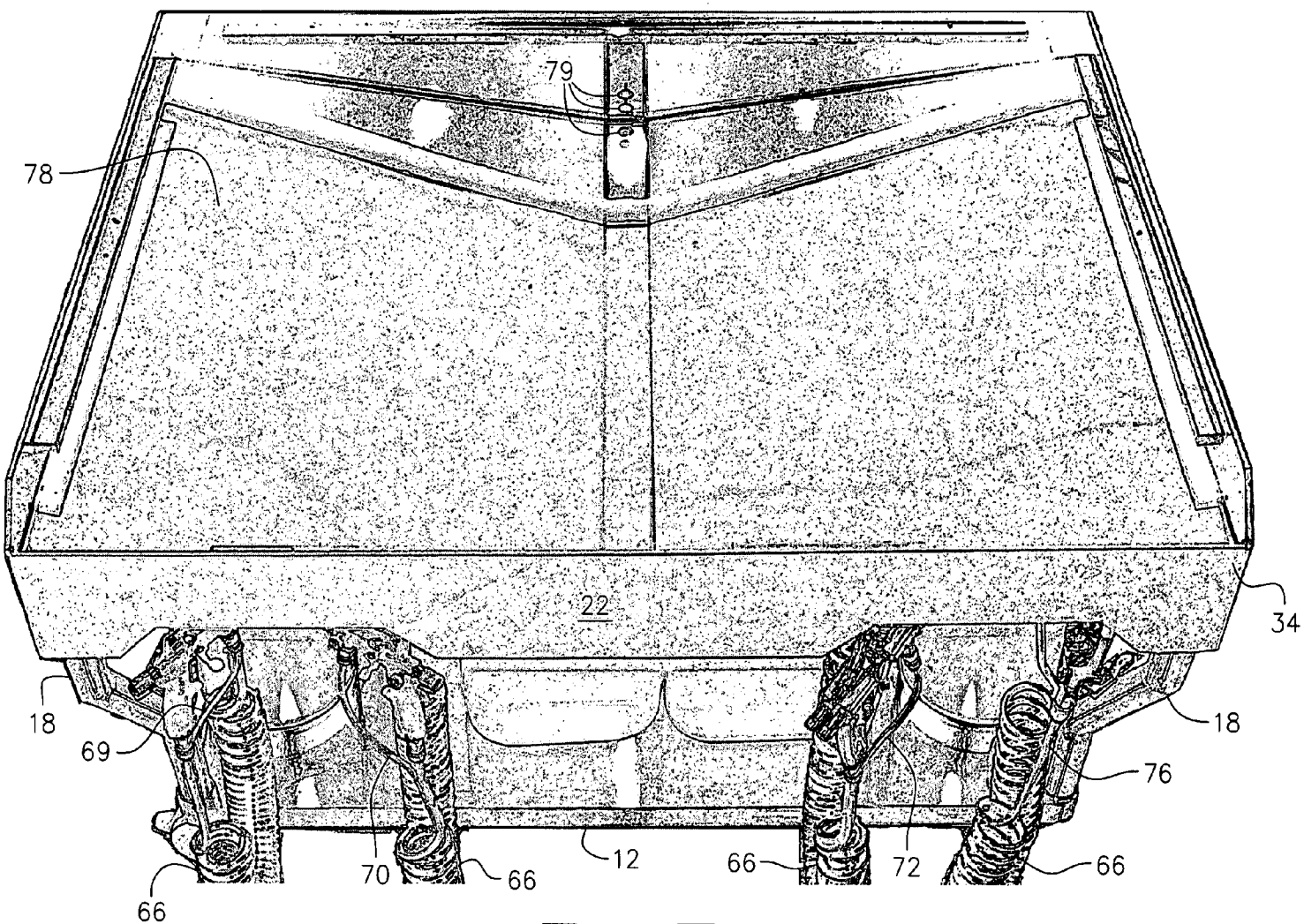
FIG. 7 is a blown up view of the drain basin under the grating.
Figure 8:
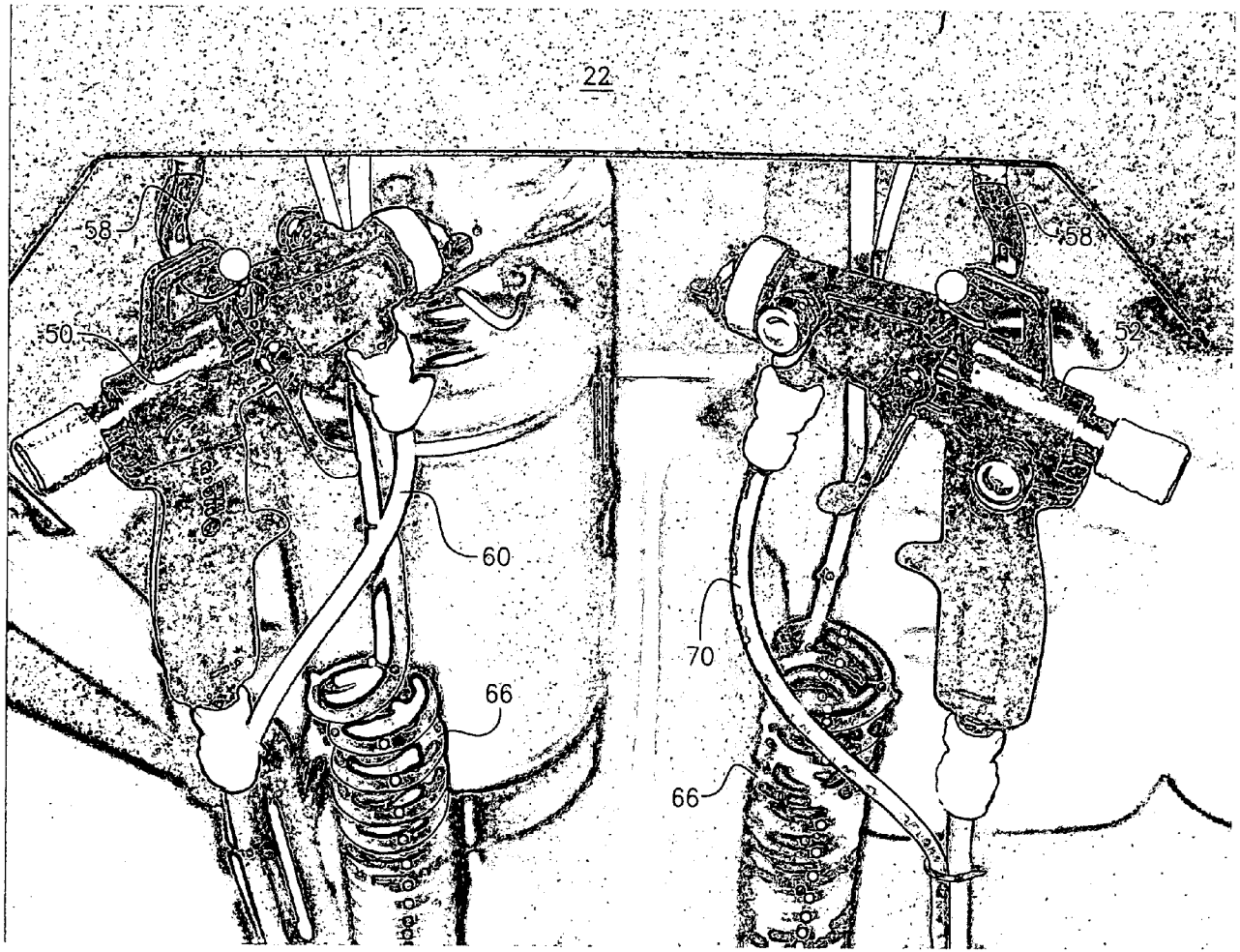
FIG. 8 is a blown up view of the left side front showing two spray guns mounted on the front wall.
Figure 9:
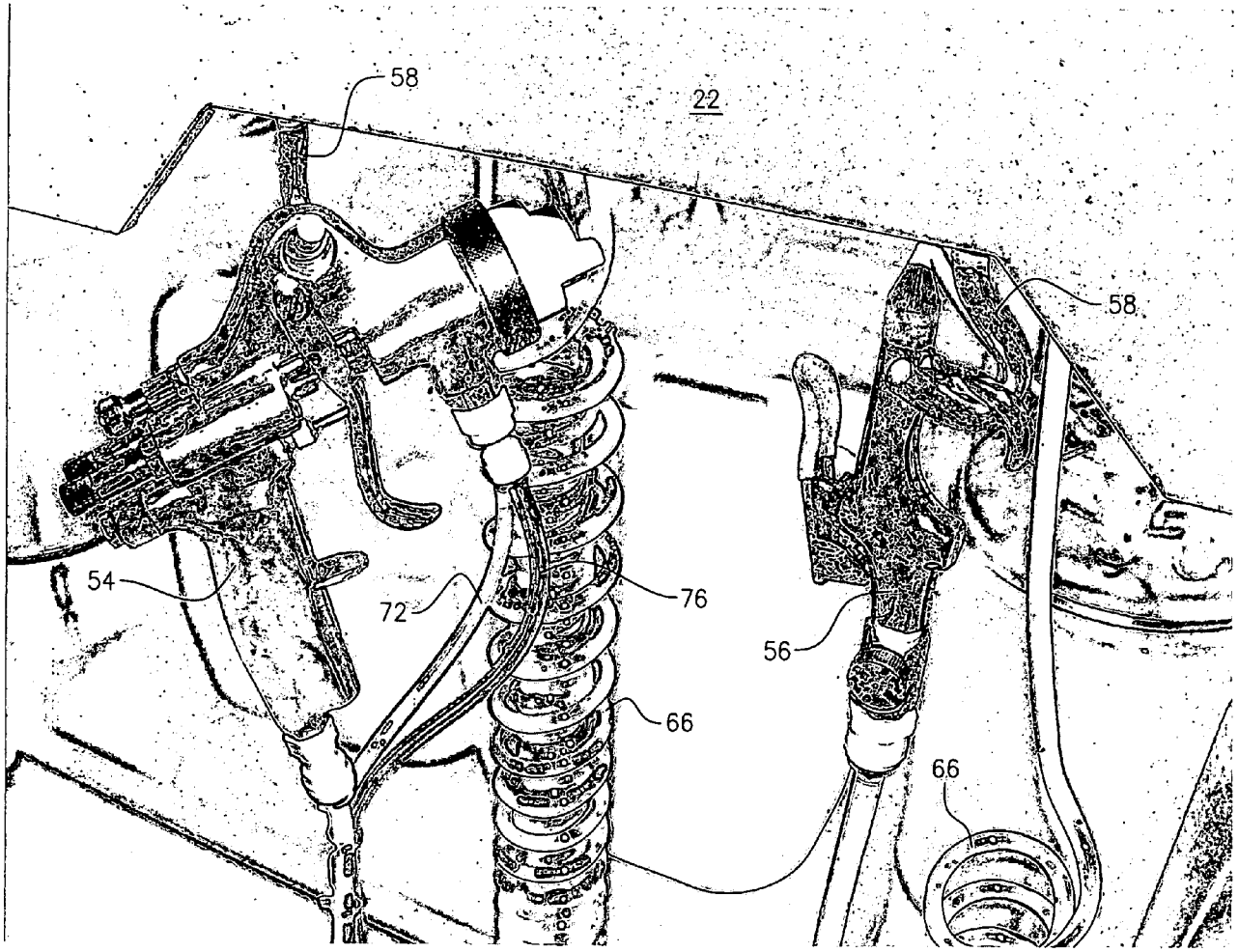
FIG. 9 is a blown up view of the right side front showing a dual headed spray gun and an air blower mounted on the front wall.

A polypropylene drain basin 78 (see FIG. 7) is mounted under grating 30 to catch run off from the metallization process. The run off passes through holes 79 in the drain basin. The run off then passes through tubes 80 to waste tanks 82 positioned on bottom tray 12 between the spray tanks 46,47 and 48,49. The waste tanks or reservoirs 82 are five gallon cans for convenience of disposal but can be any size that fits beneath the drain basin 78.

Figure 4:
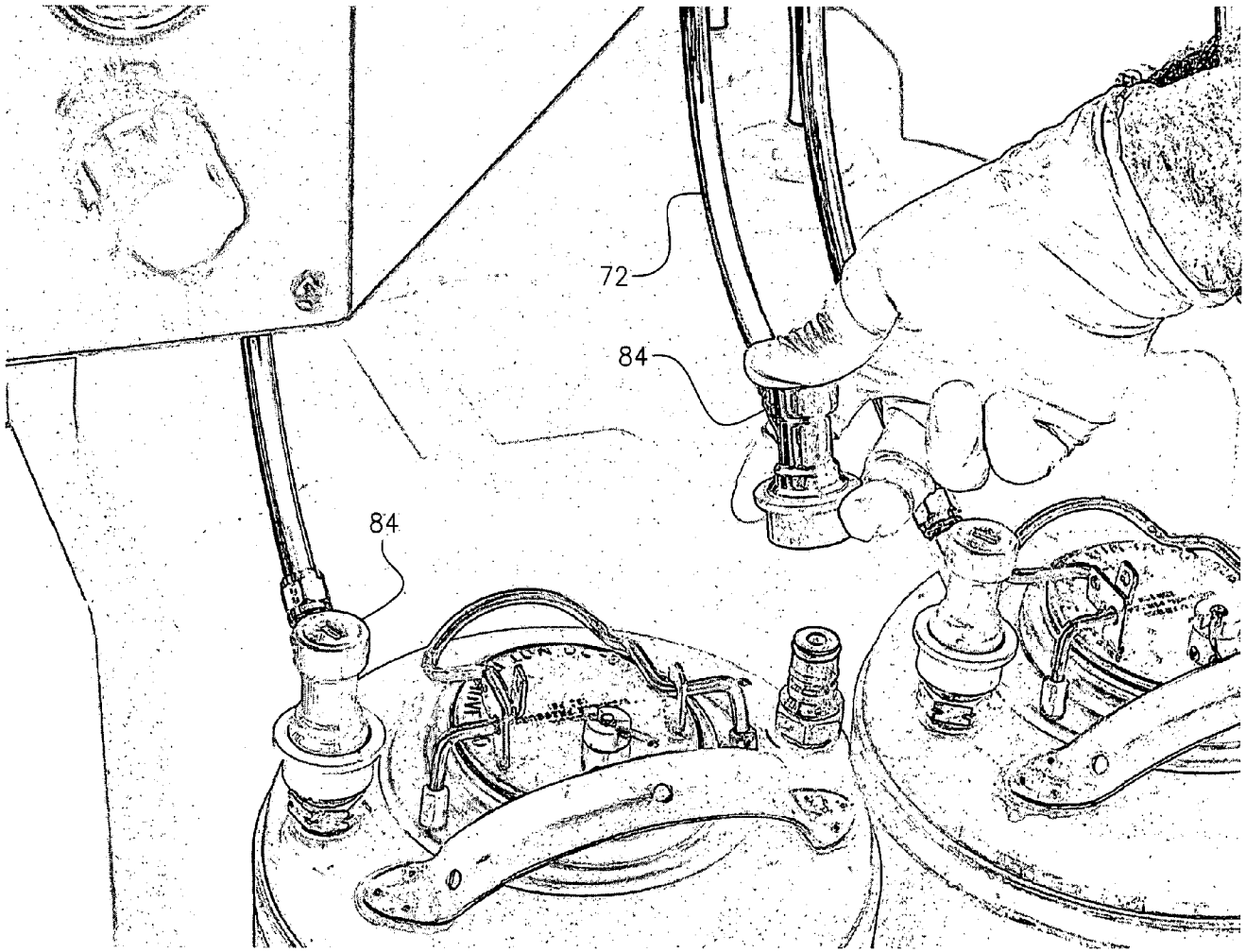
FIG. 4 is a blown up view of a quick release connector joining a hose line to a pressure tank.
Figure 5:
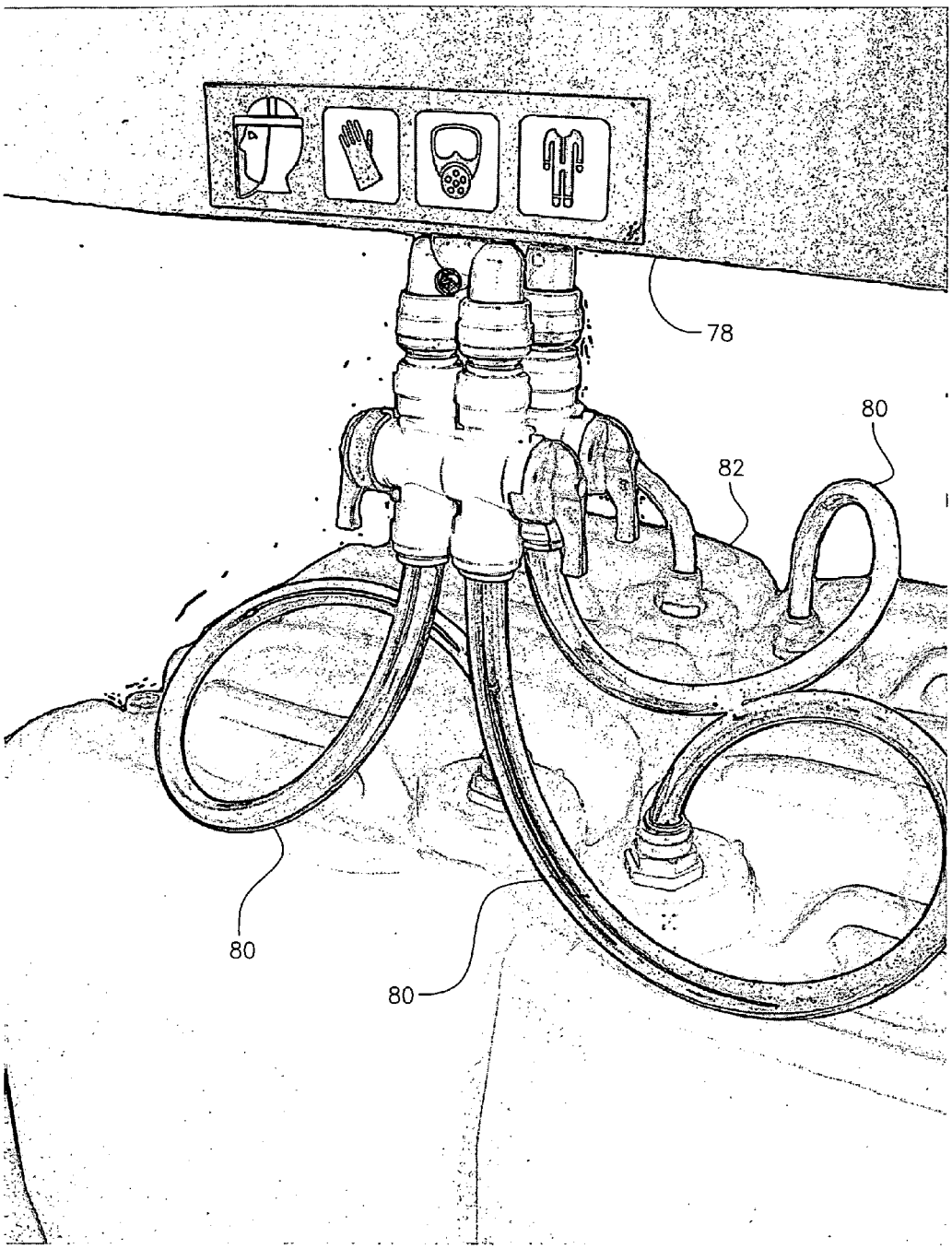
FIG. 5 is a blown up view of the hoses leading from the drain pan to the waste tanks.

Quick connect valve connectors 84 (see FIG. 4) are employed at the end of all hoses so that the empty pressure tanks can be refilled easily.

The spray gun 50 used for the sensitizer and spray gun 52 used for the de-ionized water are made of high impact plastic with stainless steel needles and internal fluid passages. The spray guns are corrosion free and fully adjustable for maximum performance. The gun 54 used for the silver nitrate and sorbitol reducer applications respectively is a specialized high volume dual headed spray guns allowing for the precise control and mixture of the two water base solutions which combine and produce the desired mirror finish. The guns are fully adjustable for any size work piece which can include glass, stone, wood, metal or plastic.

The grating 30 is stainless steel and the catch basin 78 is polypropylene for easy clean up. The frame structure is a heavy duty metal and the side walls are reinforced with stiffening member 42. A filter 86 can be used with impeller fans 37 to pick up particulate matter and prevent distribution to the atmosphere.

The metallizing process starts with the sensitizing of the surface of the article to be metallized by spraying the sensitizer through gun 50. The article is then rinsed with de-ionized water through spray gun 52. Silver nitrate and reducer are then sprayed from gun 54 onto the article to produce the chrome-like finish. The article is then rinsed with de-ionized water from gun 52, and then blown dry using air gun 56.

Various equivalent elements can be substituted for the elements described above for the metallizing spray table to provide substantially the same function in substantially the same way to achieve substantially the same result.

Having thus disclosed the invention, what is claimed and desired to be secured by Letters Patent follows:

1. A portable metallizing spray booth comprising:

a bottom tray supported by a set of wheels;

an upper frame structure spaced apart from the bottom tray by multiple vertical support rods, the upper frame structure having oppositely positioned vertical side walls joined by a vertical back wall enclosing a grated work surface, the vertical side walls having perforations for outflow of vapors;

a front vertical wall joining a bottom portion of the side walls and depending downwardly in relation to the grated work surface;

multiple pressurized spray guns, each gun connected by a tube to an air pressure source and a pressurized tank containing ingredients used in a metallizing process, the tanks mounted on the bottom tray and the spray guns supported by the front vertical wall so that an operator can access the spray guns to sequentially metallize an article positioned on the grated work surface; and a hinged housing on an outer surface of each of the vertical side walls adjacent to the perforations, the housing containing at least one impeller fan for drawing vapors through the perforations when the metallizing process is being conducted.

2. The portable metallizing spray booth according to claim 1, wherein the housing contains two impeller fans.

3. The portable metallizing spray booth according to claim 1, wherein each side wall has a strengthening member attached to an exterior wall surface.

4. The portable metallizing spray booth according to claim 1, wherein a drain basin is mounted below the grated work surface and the drain basin is connected by at least one hose to a liquid waste tank supported by the bottom tray.

5. The portable metallizing spray booth according to claim 1, wherein there are three pressurized spray guns, each connected by a hose to a pressurized tank and by a hose to a source of air pressure.

6. The portable metallizing spray booth according to claim 5, wherein the hoses connected to each spray gun are coiled together.

7. The portable metallizing spray booth according to claim 6, wherein the hoses leading to the pressurized tank are each color coded.

8. The portable metallizing spray booth according to claim 1, wherein a front portion of the grated surface steps down to provide a front edge to the grated surface inboard from the front wall.

9. The portable metallizing spray booth according to claim 1, wherein each side wall bottom portion contains at least one pressure gauge and control knob for adjusting pressure in the pressurized tanks and spray guns.

10. The portable metallizing spray booth according to claim 9, wherein each side wall contains two pressure gauges and two control knobs for adjusting pressure in corresponding pressurized tanks.

11. A metallizing spray booth mounted on multiple wheels for manual movement to and from a spray area, the spray booth comprising:

a bottom tray spaced apart from a bottom portion of an upper frame structure by multiple vertical rods, the upper frame structure having oppositely positioned vertical side walls joined by a vertical back wall of substantially the same height, the walls enclosing a grated work surface, the vertical side walls each having perforations for drawing vapors out of the spray booth during a metallizing process;

a front vertical wall joining a bottom portion of the side walls and depending downwardly in relation to the grated work surface, a front longitudinal portion of the grated work surface having a step down to a surface level below a top edge of the front vertical wall;

multiple pressurized spray guns, each gun connected by a first tube to an air pressure source and by a second tube to a pressurized tank containing liquid ingredients used in the metallizing process, the tanks mounted on the bottom tray and the spray guns supported by the front vertical wall so that an operator can metallize an article positioned on the grated work surface using the multiple spray guns;

a housing means hingedly mounted on an outside surface of each of the vertical side walls; and a means to draw vapors out of the spray booth, the means to draw vapors mounted within the housing means and adapted to draw vapors out through at least one of the perforations.

12. The metallizing spray booth according to claim 11, wherein there are three spray guns, each having a tube leading to a different pressurized tank and to the source of air pressure.

13. The metallizing booth according to claim 11, wherein a drain basin is mounted below the grated work surface to collect a waste liquid during the metallizing process, and conduct it by a drain hose to a waste tank supported by the bottom tray.

14. The metallizing spray booth according to claim 11, wherein the hoses connecting the pressurized tanks to the spray guns are color coded.

15. The metallizing spray booth according to claim 11, wherein each side wall bottom portion contains at least one pressure gauge and control knob for adjusting pressure in the pressurized tank.

16. The metallizing spray booth according to claim 15, wherein there are two gauges and two knobs on each side wall and two pressurized tanks below each side wall positioned on the bottom tray.

17. A portable metallizing spray booth comprising:

a bottom tray supported by a set of wheels;

an upper frame structure spaced apart from the bottom tray by multiple vertical support rods, the upper frame structure having oppositely positioned vertical side walls joined by a vertical back wall enclosing a grated work surface, the vertical side walls having perforations for outflow of vapors;

multiple pressurized spray guns, each gun connected by a tube to an air pressure source and a pressurized tank containing ingredients used in a metallizing process, the tanks mounted on the bottom tray so that an operator can access the spray guns to metallize an article positioned on the grated work surface; and a housing hingedly attached on an outer surface of each of the vertical side walls, the housing adjacent to the perforations and containing a means for drawing vapors through the perforations.

18. The metallizing booth according to claim 17, wherein the housing is removably attached by hinges.

19. The metallizing booth according to claim 17, wherein the means for drawing vapors is a fan.

20. The metallizing booth according to claim 17, wherein the means for drawing vapors is a fan and a filter is adapted between the perforations and the fan.

* * * * *